United States Patent [19]

Shepherd

[11] Patent Number: 4,915,877

[45] Date of Patent: Apr. 10, 1990

[54] FILL ASSEMBLY FOR COOLING TOWER

[76] Inventor: Charles E. Shepherd, 4202 Markham, Houston, Tex. 77027

[21] Appl. No.: 353,605

[22] Filed: May 18, 1989

[51] Int. Cl.[4] ..... B01F 3/04

[52] U.S. Cl. ..... 261/111; 261/113

[58] Field of Search ..... 261/111, 113

[56] References Cited

U.S. PATENT DOCUMENTS

| | | | |
|---|---|---|---|
| 3,389,895 | 6/1968 | DeFlon | 261/111 |
| 3,647,191 | 3/1972 | Fordyce | 261/111 |
| 3,911,067 | 10/1975 | Chen et al. | 261/113 |
| 4,133,851 | 1/1979 | Ovard | 261/113 |
| 4,439,378 | 3/1984 | Ovard | 261/111 |
| 4,557,878 | 12/1985 | Fulkerson | 261/111 |
| 4,705,653 | 11/1987 | Stackhouse et al. | 261/113 |

*Primary Examiner*—Tim Miles

*Attorney, Agent, or Firm*—Foley & Lardner, Schwartz, Jeffery, Schwaab, Mack, Blumenthal & Evans

[57] ABSTRACT

A fill assembly comprising an apertured fill member of generally inverted V-shape, and a tray member which receives the bottoms of the side walls of the fill. The fill and tray are formed with cooperating flange members, with the flanges of the tray defining grooves which function to constrain laterally outward movement of the legs of the fill. Deformation of the fill under loading is thereby prevented.

4 Claims, 1 Drawing Sheet

FILL ASSEMBLY FOR COOLING TOWER

BACKGROUND OF THE INVENTION

The present invention relates as indicated to a fill assembly for cooling towers, and relates more particularly to a fill assembly which can be used with both counterflow and cross-flow air movement.

Cooling towers are designed to cool water entering the top thereof and withdrawn from the bottom, and are commonly characterized by the provision of fill slats or bars packed within the tower and designed to break the water stream or large drops. This facilitates the commingling of the water and air to produce cooling of the water. The fill slats or splash bars are normally vertically and laterally offset whereby the water droplets are deflected laterally from the fill surface to similar slats or bars positioned below so that maximum water break-up and consequent cooling is effected. The terms "fill", "fill slats", "fill bars", "splash bars" and "fill splash bars" are used in the art to commonly designate members which accomplish the indicated function, and for purposes of simplicity, the term "fill" will be used hereinafter.

Recently, plastic has been used increasingly for fill, due to cost and other considerations. Plastic fill, due primarily to its lower density, has caused problems with regard to stability during use, and various retaining means have been developed to retain the fill in place. In a typical installation, the fill is supported horizontally in the cooling tower by a grid of vertical and horizontal support wires suspended in the tower. The fill is positioned between the vertical wires. Due to several factors, including uneven vertical loading on the fill during use, there is a tendency for the fill to creep longitudinally and to tip or roll between the vertical wires, thereby creating a need for retaining or stabilizing means to maintain the bars in their horizontal position. Vertical loading can result from a heavy water load, long term accumulation of algae, and ice formation, particularly at the sides of the tower.

DISCUSSION OF THE PRIOR ART

U.S. Pat. No. 3,389,895 of J. G. DeFlon discloses various forms of plastic fill. All are commonly characterized by the provision of openings formed in the various surfaces of the fill. The openings improve the efficiency in dispersing the falling water, and forming the fill of plastic material is cost efficient.

In one form of DeFlon, the cross-section is an inverted V-shape, with the legs or plates being approximately at right angles to each other. Generally diamond-shaped openings are formed throughout each of the legs or plates, with the apex or top ridge being solid to reinforce the bar, and the lateral side edges being laterally outwardly, downwardly and inwardly turned to provide a flange at either side of the fill to rest upon horizontal grid wires between vertical grid wires of the supporting grid assembly.

While the V-bar fill of DeFlon has performed generally satisfactorily, the design does have several disadvantages. The fill has a tendency to deform under vertical loading thereby potentially causing the structural failure of the fill. Under heavy loading, the 90° angle formed by the legs or splash plates tends to increase. This rapidly decreases the beam strength of the fill, bearing in mind that it is entirely open at the bottom, and allows the fill to deflect to a point where it is pulled out of the supporting hanger structure. This structural deflection, as a result of loading, is accelerated in most circumstances with increased water temperature. Large scale fill failure can occur, normally beginning in the upper areas of the tower and progressing downwardly through the tower.

A further disadvantage in the V-bar type design is the inherent instability when mounted in place. For the reasons above noted, there is a tendency for the fill to move longitudinally and also to tip or rotate. Due to the movement of the V-bar during operation, abrasion between the bar and the fill hanger wires, normally plastic coated, is a constant problem, resulting in abrasion on both components, which can become excessive. In fact, separate wear pads are frequently installed positioned between the fill hanger wires and the fill in order to reduce abrasion, with the installation of these wear pads increasing both material and labor costs.

SUMMARY OF THE INVENTION

The invention is specifically designed to overcome the above-noted disadvantages in the V-bar fill design. Although one component of the present fill assembly is similar to the V-bar disclosed in DeFlon, the improved assembly includes a second member which is adapted to close the formerly open bottom of the fill and engage and consequently immobilize the lateral edges of the fill. This maintains the beam strength of the fill even during periods of heavy loading.

Specifically, the present invention additionally comprises a bottom tray member slightly wider in dimension then the width of the V-bar fill, and formed with an upwardly and inwardly turned flange at each side to form grooves. The grooves and the width of the bottom of the tray are so dimensioned as to receive therewithin the lateral base flanges of the V-bar. This can be easily accomplished on site by pressing the side walls of the fill toward each other to position the base flanges horizontally adjacent the grooves of the tray, and releasing the resilient side walls so that the base flanges move into the groove. The side flanges of the tray thereby serve to completely confine and immobilize the side flanges of the V-bar, thereby precluding deformation of the V-bar under vertical loading.

The improved fill assembly thus comprises a fully closed triangle in cross-section, and offers several additional advantages without significantly increasing cost. In addition to improving the strength of the fill assembly for the reasons noted, the thermal efficiency is also increased. The tray member is also preferably formed with openings thereby increasing the wetted surface area of the fill assembly by approximately 70%, thus increasing the capacity of the fill by the same amount. The tray member thus does not proportionally increase the pressure drop through the fill area and, importantly, increases the lateral space occupied by the fill only by the thickness of the tray flanges.

The substantially improved operational performance is met with only minimal effects on material and installation costs. The V-bar portion of the fill assembly can be made somewhat thinner, particularly in the apex or ridge area, and such material can be allocated to the manufacture of the tray. Moreover, the bottom tray acts not only to substantially stiffen the fill assembly but also totally eliminates the need and consequent cost to install separate wear pads to reduce abrasion with the fill hanger wires. The tray increases the contact supporting surface area by a factor of approximately fifteen (15), thereby reducing the problem of abrasion wear to a minimum.

A further feature of the invention is the ease with which the new fill assembly can be installed on site. The V-bar and bottom tray can be separately transported, and the tray simply snapped onto the V-bar at the job site. The entire fill assembly can then be positioned in the wire hanger field quickly and easily, with the elimination of the provision of wear pads greatly enhancing worker safety. The new fill assembly can be utilized both on new cooling tower constructions as well as providing a quick and easy retrofit when cooling towers are reconditioned.

These and other objects of the invention will become more apparent as the following description proceeds in particular reference to the application drawings.

DETAILED DESCRIPTION OF THE PREFERRED EMBODIMENTS

Figure 1:
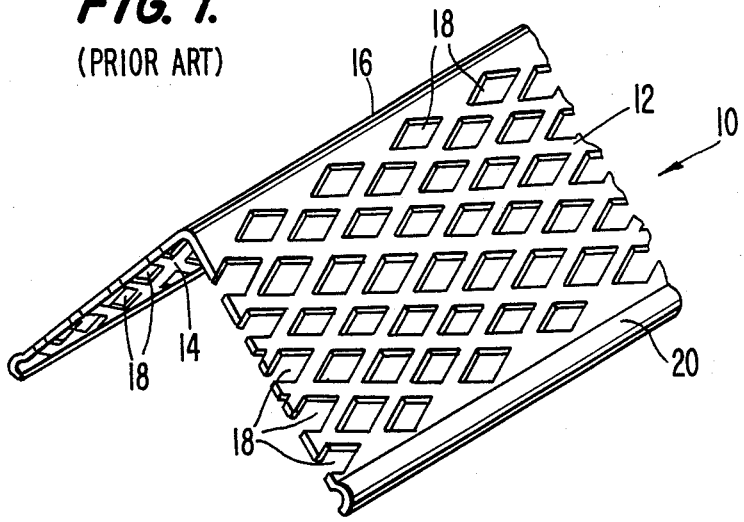
FIG. 1. (PRIOR ART)
FIG. 1 is a top perspective view of a fill member constructed in accordance with the prior art, with FIG. 1 being appropriately identified.
Figure 2:
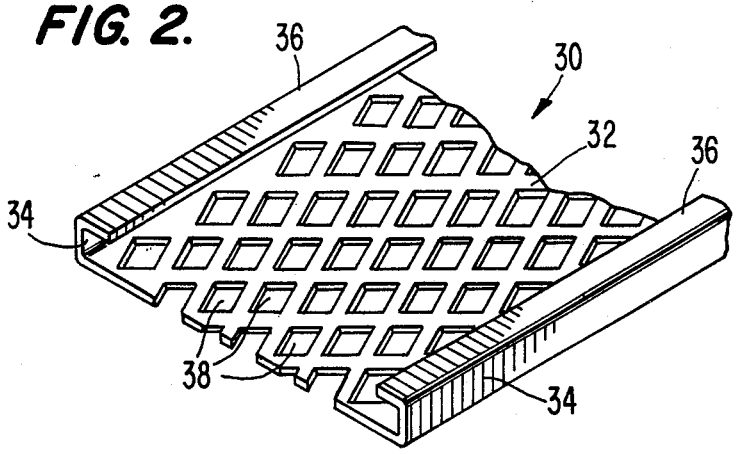
FIG. 2 is a fragmentary perspective view of the tray member constructed in accordance with the present invention.

FIG. 1 illustrates a member constructed in accordance with the DeFlon U.S. Pat. 3,389,895 referred to above, and generally indicated at 10.

The fill 10 comprises side walls 12 and 14 which upwardly converge to form a top ridge 16. The ridge may be of somewhat greater thickness then the side walls to provide greater resistance to deformation of the fill during conditions of loading. Each side wall 12 and 14 is formed with a matrix of openings commonly designated at 18 of a dimension and having a purpose to be presently described.

Figure 3:
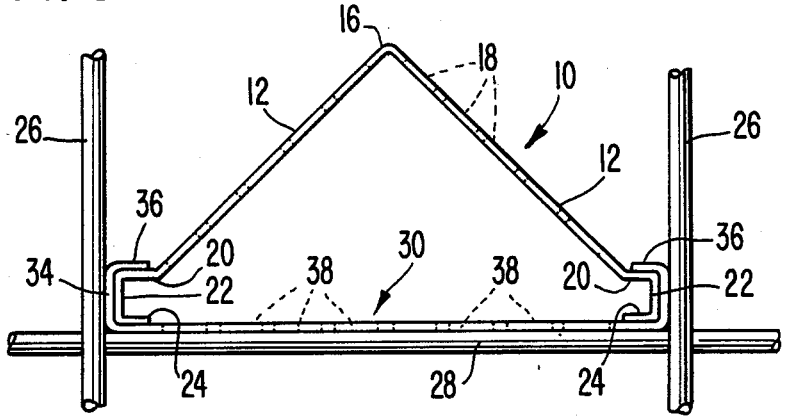
FIG. 3 is an end view showing the fill member mounted in the tray, with both being supported by hanger wires in the cooling tower.

Each side wall 12 and 14 is formed with a laterally or outwardly extending flange 20, a downwardly, generally vertically oriented flange 22, and an inturned bottom flange 24. The bottom of the fill 10 is entirely open and the sides 12 and 14 are generally perpendicular to each other. The flanges 20–24 formed at each side of the fill provide a substantial continuous surface for supporting the fill, when used separately, relative to a wire support grid assembly. In FIG. 3, vertical supporting wires commonly designated at 26 and a horizontal supporting wire 28 are illustrated, although the wire grid assembly supporting the fill assembly of the present invention forms no part of the invention.

The openings 18 in the form shown are diamond-shaped and numerous so as to form a generally open mesh pattern. The openings are large enough to allow air to pass upwardly or laterally through the openings and to prevent water descending down the side walls from forming a film over the openings. At the same time, the provision of as great a number of openings as possible is desired since the wall area surrounding each opening forms a surface against which descending water contacts so as to break up the water into smaller water droplets. All this is well known and explained in the '895 patent.

The fill of FIG. 1, when used by itself, is susceptible to deformation when excessively loaded. The downward loading tends to spread the side walls 12 and 14 laterally apart. This reduces the beam strength of the fill thereby making the fill more susceptible to deformation, which in most instances is accelerated with increased water temperature. At best, deformation can result in the fill being dislodged from its support on the wire grid, and at worst the fill can actually structurally fail under the vertical loading. Since the water is supplied at the top of the cooling tower, with consequently higher temperatures at that region, deformation and potential structural failure begins in the upper regions of the tower and progresses downwardly.

The present invention eliminates deformation of the fill under loading, as well as providing several additional advantages. The invention comprises an additional tray member generally indicated at 30 having a bottom wall 32 and side walls commonly designated at 34. Each side wall is formed at its upper end with an inwardly turned flange or lip 36, which defines with the side wall and adjacent bottom wall a groove. The bottom wall 32 is formed with openings, commonly designated at 38 which perform essentially the same function as the openings 18 described above in connection with FIG. 1. The openings are laterally offset in adjacent rows to preclude water movement along the top surface of the bottom wall of the tray, which might otherwise occur, for example, in cross-flow air movement.

The dimensions of the grooves defined by the side walls 34 and flanges 36 of the tray 30 are such that the flanges 20, 22, 24 of the fill 10 fit entirely therewithin, as shown in FIG. 3. As above described, the base flanges of the fill can be snapped into the grooves, although the fill can also be telescopically mounted. This can be accomplished on site, and the fill and tray members supplied separately to the site. The tray is dimensioned in width so as to fit between vertical supporting wires 26, and the bottom wall 32 rests on spaced horizontal supporting wires 28. It should be noted in this regard that the apertured bottom wall 32 provides a surface area of contact with the horizontal supporting wires 28 many times greater than the bottom flanges 24 of the fill 10, if only the fill is used. This greatly reduces wear due to abrasion compared to previous installations employing only the fill, and eliminates the need for the installation of separate wear pads between the fill hanger wires and the fill. The elimination of wear pads results not only in material cost savings, but also substantially reduces labor costs.

Both the fill 10 and tray 30 can be made of any acceptable, relatively rigid thermoplastics material, with polyvinylchloride providing highly satisfactory results. The members can be extruded and the openings formed by stamping. Standard duty or utility grade thicknesses of 0.035–0.045 inches are generally satisfactory, although in areas of heavy loading, for example, at the top or sides of the towers for the reasons indicated, greater thicknesses in the range of 0.075–0.085 inches can be used. The fill is reinforced somewhat at the top ridge. Any fiber reinforced thermoplastics material having the necessary properties could also be used, as well as glass reinforced thermoset products produced by pulltrusion. Regardless of the material used, a fire proofing or fire retardant additive is normally combined with the composition. No invention resides in the particular material used.

It will be seen from FIG. 3 how the mounting of the fill 10 in the tray 30 prevents vertical deformation of the fill 10 even under conditions of heavy loading. When the fill is vertically loaded, any tendency to vertically deform is directed through both the ridge 16 and the side walls 12 and 14 of the fill. Deformation is prevented due to the snug retention of the flanges of the fill within the grooves formed by the side walls 34 and top flange 36 of the tray. Any loading force on the ridge 16 and side walls 12 and 14 tends to force the flanges 20 and 22 against the adjacent side walls 34 of the tray. The rigidity of the side walls 34 and flanges 36 is such that the loading forces are completely absorbed.

In addition to preventing deformation, the tray increases the thermal efficiency of the fill assembly by substantially increasing the surface area of the volume occupied by the fill. The provision of the tray results in an approximately 70% increase in the wetted surface area within essentially the same volume of space formally occupied by the fill itself. This substantial increase in available cooling surface substantially increases the KAV/L value of the cooling tower with little effect on its construction or operating costs.

A further advantage is that the two component fill assembly can be manufactured without a significant increase in material costs. The total amount of material used for the fill and tray is not appreciably greater than used previously for the fill alone. Moreover, labor costs are comparable to the prior design. Although the fill must be snapped or positioned in the tray, the installation of wear pads is no longer necessary, with essentially off-setting results.

In addition to the increased rigidity provided by the fill assembly of the present invention, the assembly substantially decreases vibrations due to the immobilization of the fill. This reduces cyclical bending and greatly increases wear resistance. Moreover, the fact that the entire bottom of the tray is used to support the fill assembly increases hanger wire life by reducing the wear of the plastic coating on the wire immediately below the fill.

A still further advantage of the present invention is its adaptability to retrofitting. The tray and fill can be assembled on site, and quickly an easily installed.

Although the fill assembly of the present invention is particularly well suited for use in cooling towers, it could also be utilized in other environments, for example, scrubbers, degassing equipment, and gas washing equipment.

What is claimed is:

1. A fill assembly adapted to facilitate the formation of liquid droplets for enhanced contact with air or gas passing through the fill assembly, comprising:

(a) a fill member having a generally inverted V-shape cross-section open at the bottom, said fill member comprising upwardly converging side walls terminating in a top ridge, said side walls being formed with openings, the surrounding defining edges of which are adapted to engage descending streams or drops of liquid and break the same up into smaller droplets thereby increasing the total liquid surface subject to contact with the air, the downwardly and outwardly diverging bottoms of said side walls being laterally spaced from a longitudinal axis through said top ridge, and (b) a generally flat bottom member extending between and interconnected to the bottoms of said side walls to close off the open bottom of said fill member, said interconnection being such as to substantially inhibit downward deformation of said ridge and lateral spreading of said side walls responsive to heavy loading on said fill assembly, said bottom member being apertured to provide an additional surface for droplet formation.

2. The fill assembly of claim 1 wherein the included angle between said side walls of said fill members is less than 180°.

3. The fill assembly of claim 1 wherein said interconnection between said fill member and said bottom member comprises flanges formed at the bottom ends of said side members, and wherein said bottom member comprises a tray including side portions adapted to receive said flanges of said fill.

4. The fill assembly of claim 1 wherein said bottom member comprises a tray including a bottom wall, upstanding side walls, and inwardly turned flanges at the tops of said side walls, said bottom wall, side walls and flanges defining grooves at both sides of said tray, and wherein the side walls of said fill member are formed at their bottoms with laterally outwardly extending flanges, downwardly extending side flanges, and inwardly extending bottom flanges, all of said flanges at each side of said fill member being dimensioned to be received within the grooves formed in said tray.

* * * * *